United States Patent [19]

Blades

[11] 4,409,450

[45] Oct. 11, 1983

[54] DOUBLE POLE MEMBRANE SWITCH HAVING PREFERRED SEQUENCE CLOSING FEATURE

[75] Inventor: Brian J. Blades, Woburn, Mass.

[73] Assignee: AMP Incorporated, Harrisburg, Pa.

[21] Appl. No.: 402,876

[22] Filed: Jul. 29, 1982

[51] Int. Cl.[3] ..... H01H 13/54

[52] U.S. Cl. ..... 200/159 B; 200/5 A

[58] Field of Search ..... 200/159 B, 5 A

[56] References Cited

U.S. PATENT DOCUMENTS

| | | | |
|---|---|---|---|
| 3,916,360 | 10/1975 | Pedersen et al. | 200/159 B |
| 4,085,306 | 4/1978 | Dunlap | 200/159 B |
| 4,246,452 | 1/1981 | Chandler | 200/5 A |
| 4,258,096 | 3/1981 | LaMarche | 428/209 |
| 4,264,797 | 4/1981 | Parkinson | 200/159 B |
| 4,271,333 | 6/1981 | Adams et al. | 179/90 K |
| 4,301,337 | 11/1981 | Eventoff | 200/159 B |
| 4,307,275 | 12/1981 | Larson et al. | 200/159 B |

*Primary Examiner*—John W. Shepperd

*Attorney, Agent, or Firm*—Frederick W. Raring

[57] ABSTRACT

Membrane switch device comprises first and second parallel insulating supports having opposed first and second surfaces. A first surface central contact and a peripheral contact are provided on the first surface, the peripheral contact extending around and being isolated from the first surface central contact. The first surface central contact and the peripheral contact have commoning extensions which project towards each other and have adjacent free ends. The free ends of the extension define a commoning locus that surrounds the center of the switch site. The second surface has a second surface central contact thereon which is opposed the first surface central contact and a commoning contact which is opposed to and, conforms to, the commoning zone. The shorting contact is electrically isolated from the second surface central contact. Circuit conductors extend to both contacts on the first surface and to the second surface central contact only on the second surface. When the switch is closed, one closing sequence is excluded; the second surface central contact can not be connected to the first surface peripheral contact before it is connected to the first surface central contact.

10 Claims, 5 Drawing Figures

14
12
52
24
10
18
20
8
30
22
6
16
32
4

DOUBLE POLE MEMBRANE SWITCH HAVING PREFERRED SEQUENCE CLOSING FEATURE

FIELD OF THE INVENTION

This invention relates to membrane switches of the type in which two contacts on one surface are engaged with one contact on a second surface when the switch is closed. The invention is particularly concerned with the sequence in which the switch contacts are engaged with each other when the switch is closed.

BACKGROUND OF THE INVENTION

A widely used type of membrane switch serves to connect two circuit conductors on one surface to one surface conductor on a second surface. A switch of this type is of the double pole single throw type in that when one of the membranes is pressed towards the other membrane, one conductor is connected to two conductors on the other membrane.

In known types of membrane switches of the double pole single throw type, the two switch contacts on the one surface will engage or contact the one switch contact on the second surface substantially simultaneously in most instances when the switch is closed. However, it is always possible that one of the contacts on the first surface will engage or contact the single contact on the second surface before the second contact on the first surface is brought into engagement with the single contact on the second surface. Sequential closing of this type can occur, for example, when the person operating the device on which the switch is provided presses the switch site with a pointed instrument such as a pencil point so that the closing force is applied only to a localized area. Most membrane switches are designed to be closed by finger pressure, and if finger pressure is applied, the closing force is distributed over a relative extensive area rather than concentrated in a very limited area.

In many electronic devices, it is of no consequence if the contacts of a double pole single throw switch do not engage or contact each other at the same instant. However, it is important in some devices that certain sequences of closing be avoided if the device is to function in its intended manner. If the two contacts only of a double pole single throw switch are engaged with each other in some electronic devices, a totally unacceptacle result will follow and the operator may conclude that there is a malfunction in the device. The probability of improper closing sequence in a given switch may be very slight, but it is nonetheless important that the switch be designed to exclude improper closing sequence entirely.

The present invention is directed to the achievement of a double pole single throw membrane switch which, when closed, will positively exclude the possibility of one of the contacts being connected to a second one of the contacts before it is connected to the third contact. Stated another way, the invention is directed to the achievement of a membrane switch in which a preferred contact closing sequence will be followed or all of the contacts will be pressed into engagement with each other simultaneously.

A membrane switch device in accordance with the invention comprises first and second parallel spaced-apart insulating supports which have opposed first and second surfaces and have opposed contact means on the opposed surfaces forming an electrical switch. At least one of the supports is flexible so that the supports can be moved relatively towards and against each other until the opposed contacts are against each other. A switch in accordance with the invention is particularly characterized in that the contact means on the first surface comprises two electrically separate and adjacent contacts, one of the contacts having a first surface main contact portion and a commoning portion. The other contact on the first surface has a commoning portion which is adjacent to the commoning portion of the main contact portion. The two commoning portions define a commoning zone on the first surface. The contact means on the second surface comprises a second surface main contact portion and a second surface commoning portion which is electrically isolated from the second surface main contact portion. The second surface commoning portion is located such that it is against the commoning zone on the first surface when the second surface is moved relatively against the first surface. The second surface main contact portion is against the first surface main contact portion when the surfaces are against each other. A second surface circuit conductor on the second surface extends to the second surface main contact portion and first surface circuit conductors on the first surface extend to the two contacts on the first surface. Upon relative movement of the second surface towards the first surface the second surface circuit conductor will be electrically connected to both circuit conductors on the first surface and the sequence of connection will exlude the possibility of the second surface circuit conductor being connected to the other contact on the first surface prior to its being connected to the first surface main contact portion.

In accordance with further embodiments, the contact means on the first surface comprises a first surface central contact and a peripheral contact which surrounds the central contact. The commoning portions comprise commoning extensions which extend towards each other.

In accordance with further embodiments, the first surface peripheral contact, the commoning zone, and the second surface commoning portion are substantially circular.

DESCRIPTION OF THE DRAWINGS

As shown in FIGS. 1 and 2, a switch assembly 2 in accordance with the invention comprises a base member 4, a first insulating support 6 having contact means 22 thereon, a separator 8, a second insulating support 10 having contact means 24 thereon and a cover 12. The cover is somewhat flexible and has the switch site indicated at 14 by a numeral or other marking. The support 6 has an upper surface 16 which is opposed to the lower surface 18 of the upper support 10. The separator 8 has an opening 20 therein at the switch site so that the flexible upper support 10 can be moved downwardly to close the switch. The supports 6, 10 may be of polyester or other suitable film and the conductors, including the switch contacts, may be metallized conductors produced by electro-deposition, or they may be screened on conductive inks. In the following description, the surface 16 is referred to as the first surface and the surface 18 as the second surface.

Referring now to FIG. 3, the switch contact means 22 on the surface 16 comprises a first surface central contact 26 and a peripheral contact 28. The peripheral contact is generally circular and surrounds the central contact. First surface circuit conductors 30, 32 extend to the central contact 26 and the peripheral contact 28, respectively. These circuit conductors normally extend to the electrical devices controlled by the switch.

Figure 1:
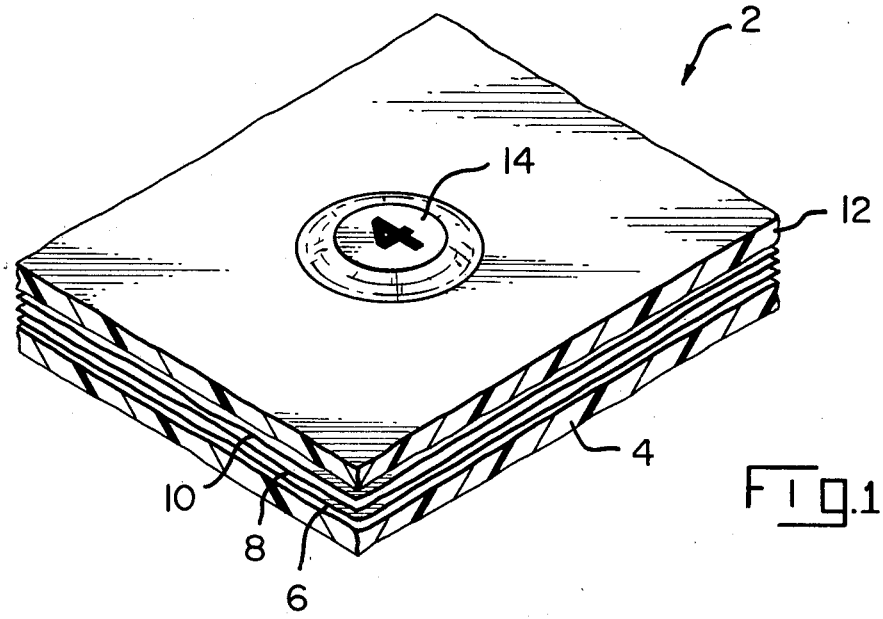
FIG. 1 is a fragmentary view of a portion of a panel containing an individual switch in accordance with the invention.

The first surface central contact 26 comprises a main contact bar 34 which extends through the center of the switch site and which merges with the circuit conductor 30. Commoning extensions 36 extend from the main contact bar 34 as branches extending normally of the axis of the main contact bar. Additional commoning extensions 38 extend from the main contact bar adjacent to the ends of the bar 34 and the extensions 38 are somewhat shorter than the extensions 36 for reasons which will become apparent. Additional branches 40 extend laterally from the main contact bar but these branches do not participate in the commoning function carried out by the extensions 36, 38; the extensions 40 are present to insure that the second surface central contact 50 will engage the first surface central contact 26.

The peripheral contact 28 is not a complete circle but has ends 42. A plurality of peripheral contact commoning extensions 44 extend from the peripheral contact inwardly towards the bar 34 of the first surface central contact.

Figure 3:
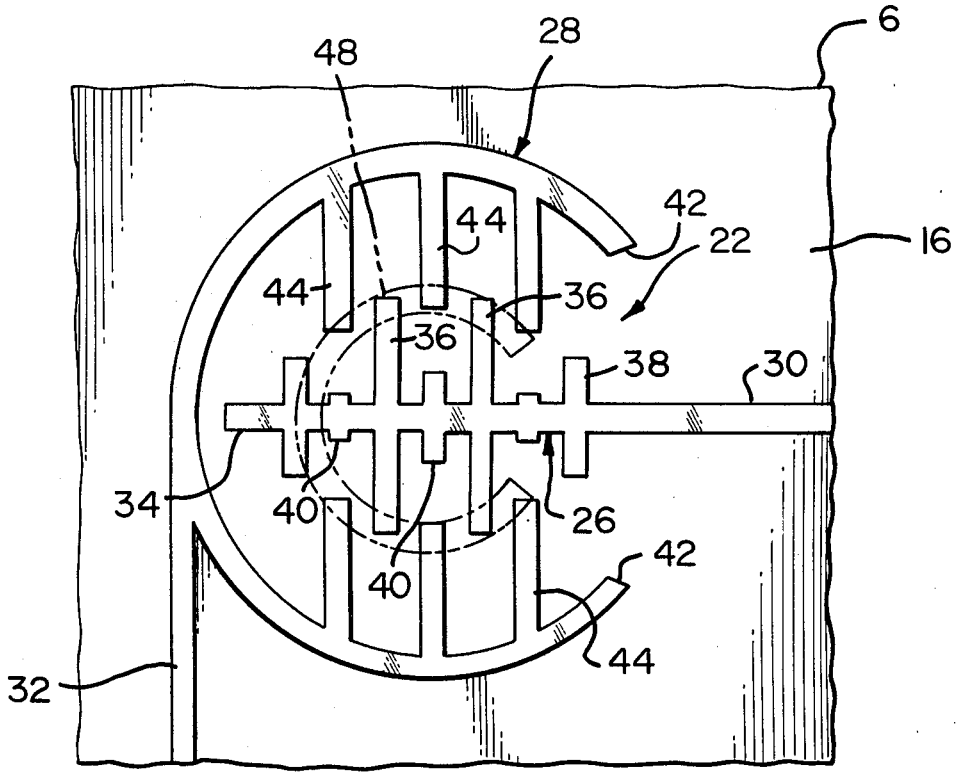
FIG. 3 is a plan view of one of the insulating supports of the switch and showing the two switch contacts on the support.
Figure 2:
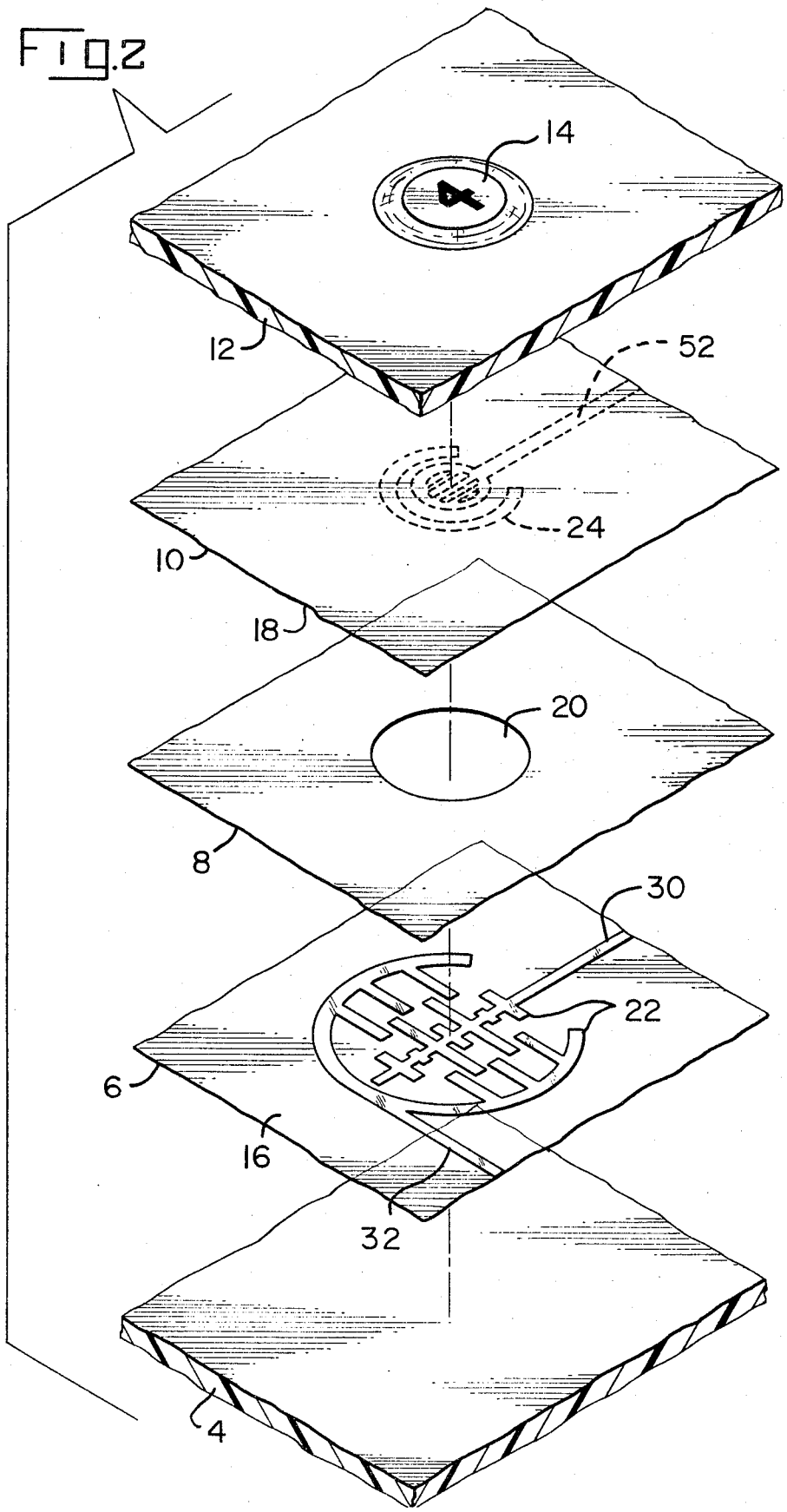
FIG. 2 is a view similar to FIG. 1 but showing the parts of the switch exploded from each other.
Figure 4:
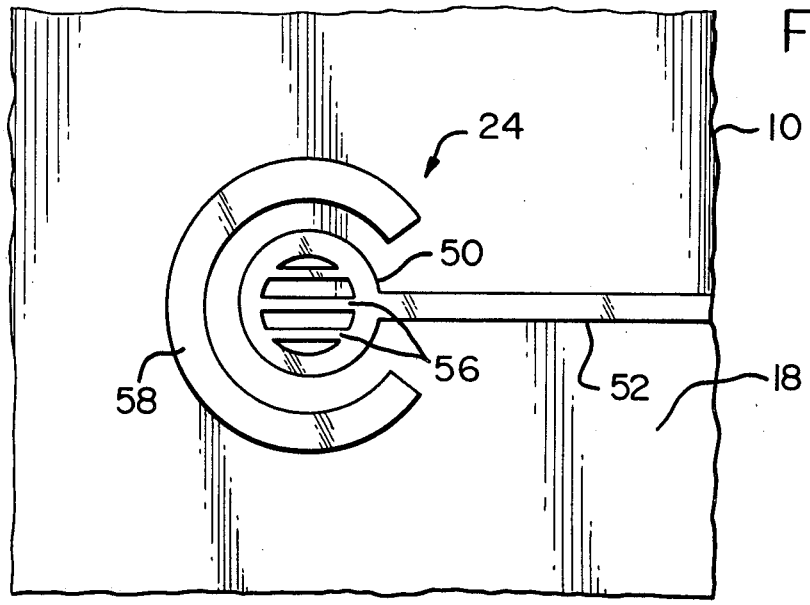
FIG. 4 is a plan view of the surface of the other support showing the switch contacts on the other support.
Figure 5:
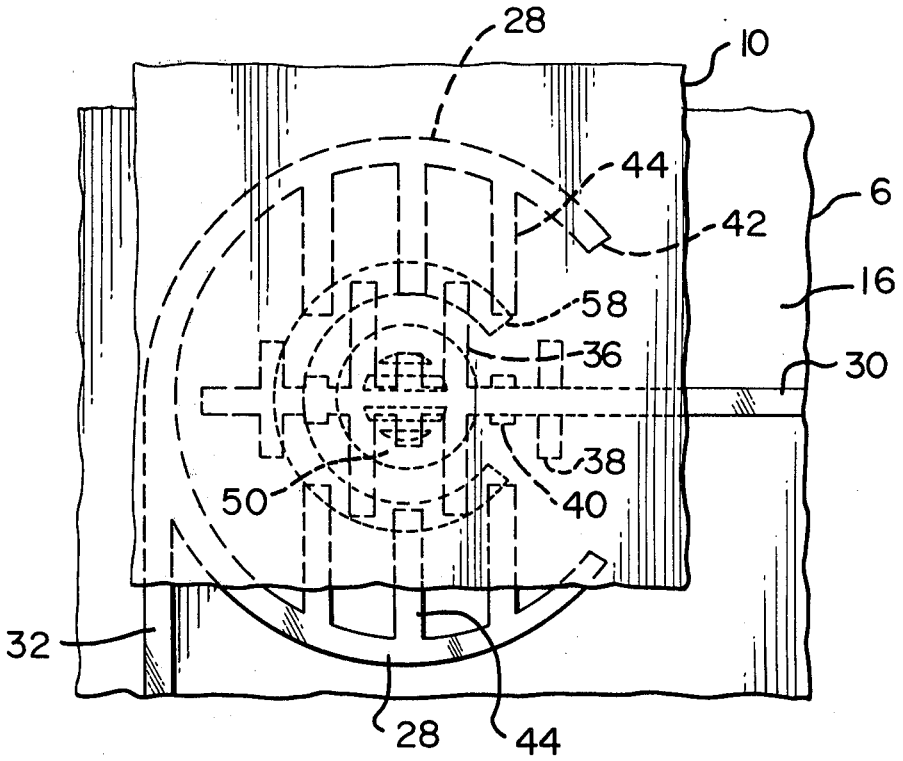
FIG. 5 is a plan view showing the relationship of the switch contacts of FIGS. 3 and 4 to each other when the switch is closed.

The free ends of the extensions 36, 38 and 44 are adjacent to each other and define a circular shorting zone indicated at 48 by phantom lines in FIG. 3. In the disclosed embodiment, these free ends of the commoning extensions 36, 44 overlap and in any event, the free ends should be sufficiently close to each other to permit them to be electrically connected to each other by a commoning conductor 58 on the surface 18 as will be described below.

The contact means 24 on the second surface 18, that is the lower surface of the second insulating support 10, comprise a second surface central contact 50 and a commoning contact 58 which surrounds the central contact 50. The central contact 50 is circular in form but has an open center through which extend conductors 56. This design is used in order to reduce the amount of ink required for the circle. As explained previously, the extensions 40 on the bar 34 are contacted by the circular portion 50 and the bars 56 of the second surface central contact when the switch is closed.

The commoning conductor 58 is generally circular but is an incomplete circle and the circuit conductor 52 extends from the central conductor through the resulting gap in the commoning conductor 58. The conductor 58 is opposed to and conforms in shape and size to the commoning zone 48 on the surface 16.

In use, when the active area 14 of the cover 12 is pressed, the membrane support 10 is flexed downwardly and the contact means 24 on the surface 18 are brought into engagement with the contact means 22 on the surface 16 so that the second surface circuit conductor 52 is connected to the first surface circuit conductors 30, 32.

If the closing force is applied uniformly to an extensive portion of the areas of active zone 14, the probability is that the contacts 50, 58 on the surface 18 will simultaneously engage the contacts 26, 28 on the surface 16. If simultaneous engagement is achieved, the second surface central contact 50 will contact the first surface central contact 26 and the commoning conductor 58 will move into the commoning zone 48 so that it will extend over the free ends of the extensions 36, 44. The commoning conductor will thus provide a conductive path from the central contact 26 on the first surface to the peripheral contact 28 on the first surface 16.

If, however, a localized closing force is applied to the zone 14 and the closing force is not on the center of the zone, it is possible that the commoning conductor 58 will be moved against, and into contact with, the free ends of the extensions 36, 44 and the central contact 50 on the second surface will not contact the central contact 26 on the first surface 16. If this happens, however, the circuit conductor 52 will not be connected to either of the circuit conductors 30, 32 for the reason that the commoning conductor 58 is electrically isolated from the second surface central contact 50. If the operator does not achieve closure of the switch, it will soon be realized and a more uniform force will be applied to the zone 14. When the additional force is applied, the contact 50 will engage contact 26 and circuit conductor 52 will be connected to circuit conductors 30, 32 simultaneously.

It will be apparent from the foregoing description that it is impossible to connect the circuit conductor 52 to the circuit conductor 32 prior to its being connected to the circuit conductor 30. The only possible non-simultaneous sequence is the connection of the circuit conductor 52 to the circuit conductor 30 followed by connection of the circuit conductor 52 to the circuit conductor 32 while connection to circuit conductor 30 is maintained.

A switch in accordance with the invention can have contacts having shapes significantly different from the shapes of the contacts shown in the drawing and described above. The location of the central and peripheral contacts in the disclosed embodiment is probably the most logical arrangement of contacts in accordance with the invention. However, the main contact on the first surface can simply have shorting or commoning extensions projecting laterally from the center of the switch zone and the second contact on the first surface can simply have commoning extensions inter-digitated with commoning extensions extending from the first contact. The commoning contact on the second surface would, as described above, conform in shape and size to the commoning zone on the first surface and be electrically isolated from the main contact on the second surface to which the second surface circuit conductor extends.

I claim:

1. A membrane switch device of the type comprising first and second parallel spaced-apart insulating supports, the supports having opposed first and second surfaces and having opposed contact means on the opposed surfaces forming an electrical switch means, at least one of the supports being flexible whereby upon movement of the supports towards and against each other until the opposed contacts are against each other, the switch means is closed, the switch means being characterized in that:

the contact means on the first surface comprises two electrically separate and adjacent contacts, one of the contacts having a first surface main contact portion and a commoning portion, the other contact on the first surface having a commoning portion which is adjacent to the commoning portion of the main contact portion, the two commoning portions defining a commoning zone on the first surface, the contact means on the second surface comprises a second surface main contact portion and a second surface commoning portion which is electrically isolated from the second surface main contact portion, the second surface commoning portion being against the commoning zone and the second surface main contact portion being against the first surface main contact portion when the second surface is moved relatively towards and against the first surface, a second surface circuit conductor on the second surface extends to the second surface main contact portion and first surface circuit conductors on the first surface extend to the two contacts on the first surface whereby, upon relative movement of the second surface towards the first surface, the second surface circuit conductor will be electrically connected to both circuit conductors on the first surface, and the sequence of connection will exclude the possibility of the second surface circuit conductor being connected to the other contact on the first surface prior to its being connected to the first surface main contact portion.

2. A membrane switch device as set forth in claim 1 characterized in that the first surface main contact portion is at least partially surrounded by the other contact on the first surface.

3. A membrane switch device as set forth in claim 2 characterized in that the commoning portion of the first surface main contact portion and the commoning portion of the other contact on the first surface comprise inter-digitated commoning extensions.

4. A membrane switch device of the type comprising first and second parallel spaced-apart insulating supports, the supports having opposed first and second surfaces and having opposed contact means at a switch site on the opposed surfaces forming an electrical switch means, at least one of the supports being flexible whereby upon movement of the supports towards and against each other until the opposed contact means contact each other, the switch means is closed, the switch means being characterized in that:

the contact means on the first surface comprises a first surface central contact and a peripheral contact, the peripheral contact extending around, and being electrically isolated from, the first surface central contact, the first surface central contact having central contact commoning extensions which project outwardly towards the peripheral contact, the peripheral contact having peripheral contact commoning extensions which project inwardly towards the central contact, the first surface central contact commoning extensions and the peripheral contact commoning extensions having free end portions which are adjacent to each other and which define a commoning zone substantially surrounding the center of the switch site, the contact means on the second surface comprises a commoning contact which is opposed to the commoning zone and a second surface central contact, the commoning contact extending around the second surface central contact, the commoning contact being electrically isolated from the second surface central contact, whereby, upon relative movement of the second surface towards the first surface, the second surface central contact will be electrically connected to both contacts on the first surface, and the sequence of connection will exclude the possibility of the second surface central contact being connected to the first surface peripheral contact prior to its being connected to the first surface central contact.

5. A membrane switch device as set forth in claim 4 characterized in that the first surface central contact commoning extensions have free ends which overlap the free ends of the peripheral contact commoning extensions.

6. A membrane switch device as set forth in claim 4 characterized in that first surface circuit conductors extend to the first surface central contact and to the peripheral contact and a second surface circuit conductor extends to the second surface central contact.

7. A membrane switch device as set forth in claim 4, characterized in that the peripheral contact, the commoning contact and the second surface central contact all have substantially circular outlines.

8. A membrane switch device as set forth in either of claims 4 or 7 characterized in that the first surface central contact comprises a main contact bar, the first surface central contact commoning extensions extending from the main contact bar.

9. A membrane switch device as set forth in claim 8 characterized in that the first surface central contact commoning extensions are parallel to each other and extend from the main contact bar at intervals.

10. A membrane switch device as set forth in claim 9 characterized in that the peripheral contact commoning extensions are parallel to, and offset from, the first surface central contact commoning extensions.

* * * * *